United States Patent [19]

Karp et al.

[11] 4,066,107

[45] Jan. 3, 1978

[54] PACKAGING MACHINE AND METHOD FOR CHITTERLINGS

[76] Inventors: Alexander Karp; Alfred Boron, both of 1445 E. Kirby, Detroit, Mich. 48211

[21] Appl. No.: 718,089

[22] Filed: Aug. 26, 1976

[51] Int. Cl.[2] ..... B65B 3/04

[52] U.S. Cl. ..... 141/11; 141/129; 141/284; 214/17 C; 222/447; 222/450

[58] Field of Search ..... 141/129, 174, 284; 214/17 C; 222/447, 450, 1, 11

[56] References Cited

U.S. PATENT DOCUMENTS

| | | | |
|---|---|---|---|
| 2,111,915 | 3/1938 | MacMillin | 222/447 |
| 3,980,109 | 9/1976 | Trueman et al. | 141/174 |

FOREIGN PATENT DOCUMENTS

| | | | |
|---|---|---|---|
| 331,319 | 7/1930 | United Kingdom | 214/17 C |

*Primary Examiner*—Houston S. Bell, Jr.
*Attorney, Agent, or Firm*—Krass & Young

[57] ABSTRACT

A machine and method for filling containers with controlled volumes of chitterlings is supplied by a hopper that is loaded from its open top from a vessel filled at ground level and then elevated and dumped into the hopper. A volumetric dispenser at the bottom of the hopper employs a cut-off blade cooperating with spaced scissor end plates to separate a volume to be dispensed from the bulk quantity by scissoring off the chitterlings. Open top containers are carried beneath the dispensing end on a conveyor and then the filled containers are moved to a turn-table where they may be manually capped.

5 Claims, 4 Drawing Figures

Fig-1
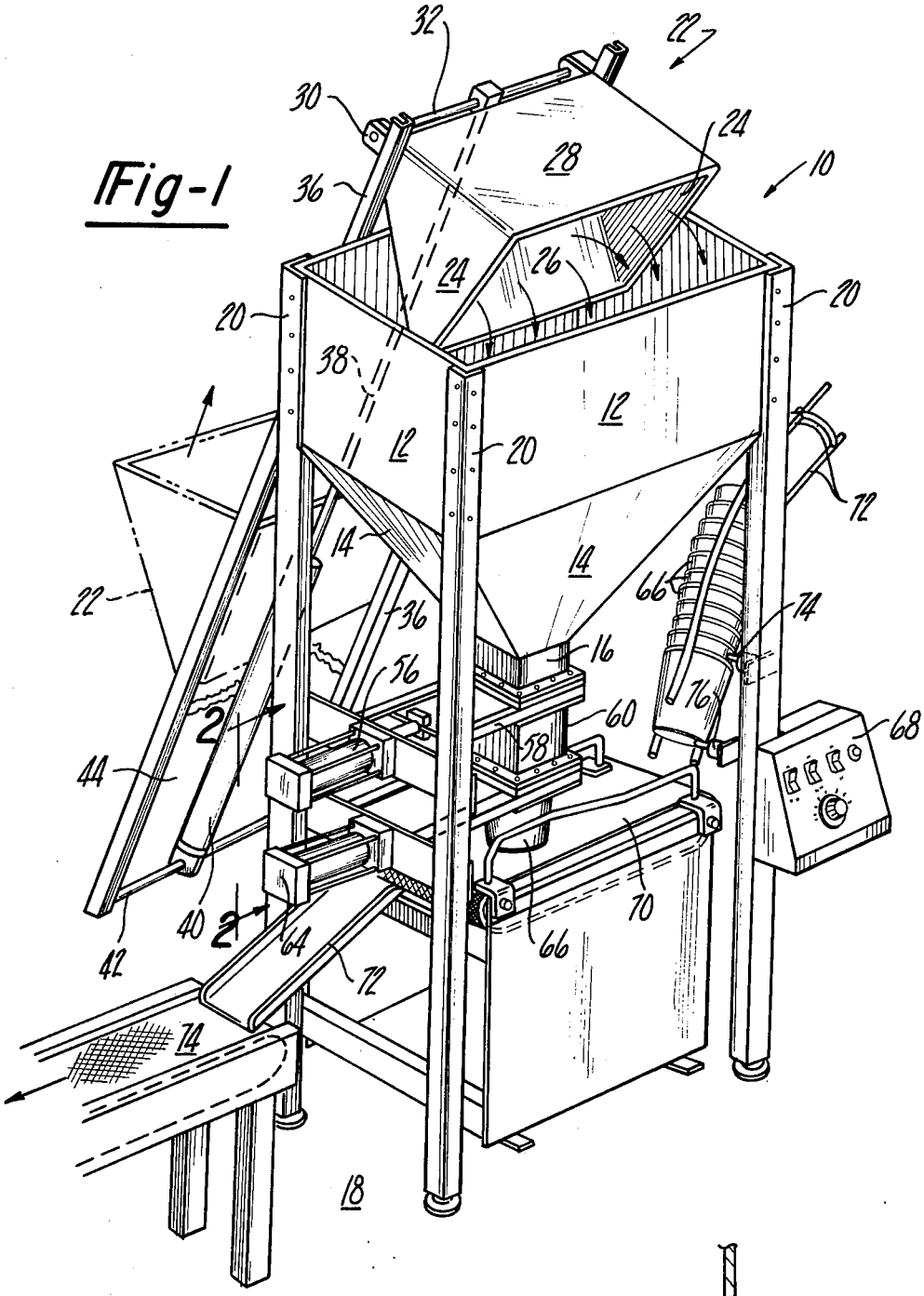
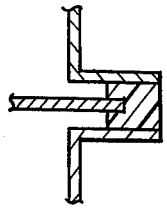
Fig-4

Fig-2
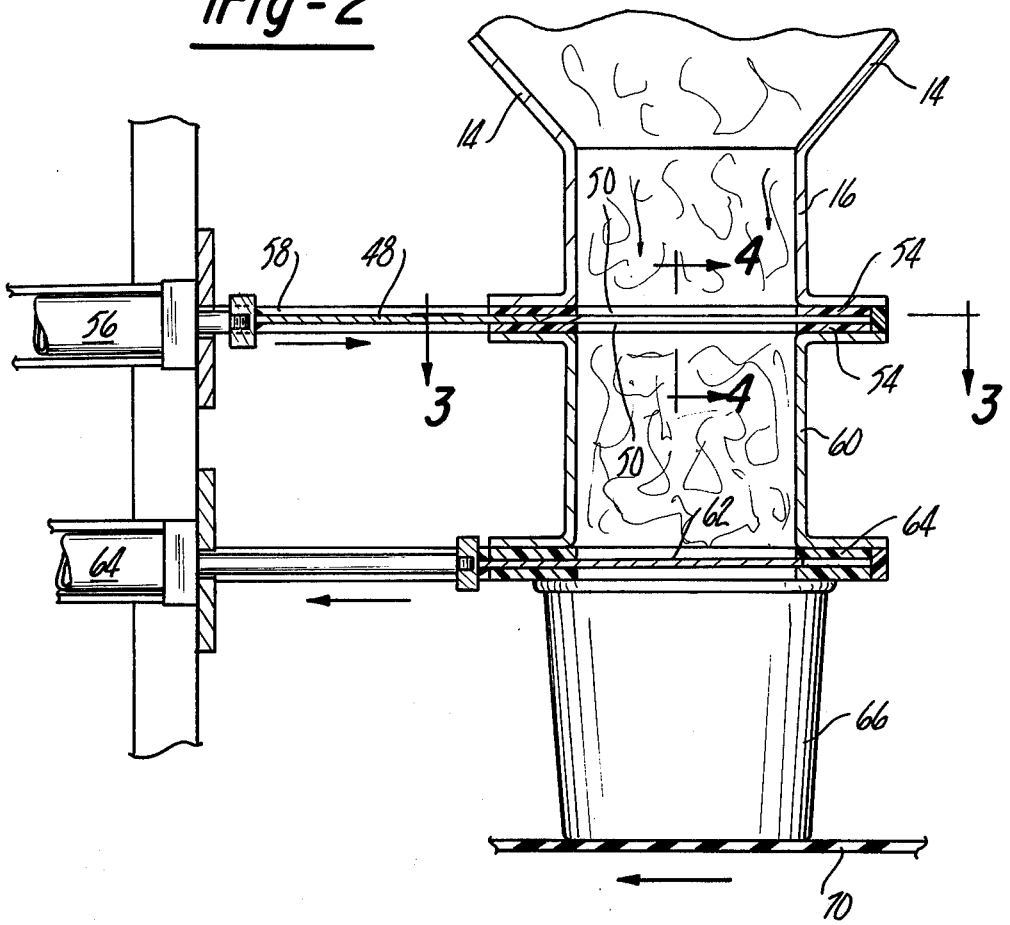
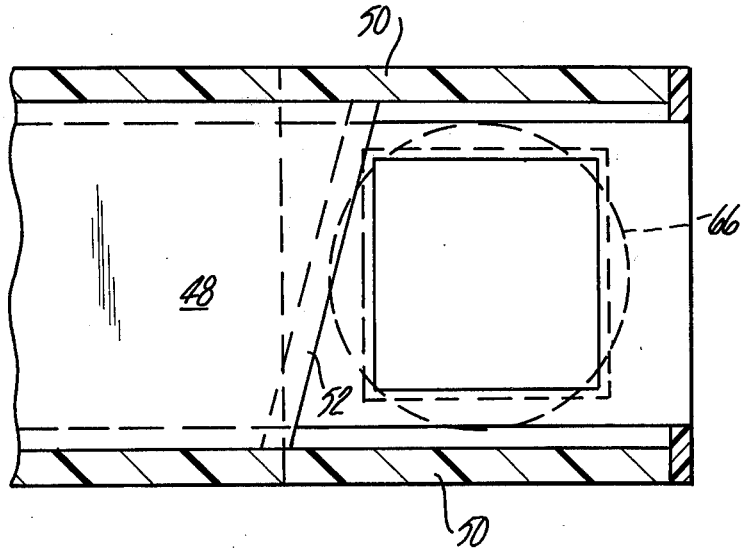
Fig-3

PACKAGING MACHINE AND METHOD FOR CHITTERLINGS

BACKGROUND OF THE INVENTION

1. FIELD OF THE INVENTION

This invention relates to apparatus for receiving bulk volumes of chitterlings and dispensing them in quantity volume bases, into individual containers.

2. BACKGROUND OF THE INVENTION

Chitterlings, the small intestines of hogs, is a nutritious, low-cost food that is popular in certain regions of the country, and among certain social and ethnic groups at least partially because of its low cost. However, one of the factors that tends to raise the market cost of chitterlings is the difficulty of handling and packaging them. This difficulty arises in part because of the structural nature of the intestines, that is, long, soft, intertwined strings of material which are not susceptible to ready separation.

In the past, the task of separating a desired small weight or volume of chitterlings from a larger mass, which often represents a bulk group of a large number of intestines, as accumulated in a slaughterhouse, was performed on a manual basis, using a knife to cut away the desired portion. This manual technique is well suited to butcher shops where customers purchase varying quantities of chitterlings, but is cumbersome, and expensive in labor terms when used in a packing house to fill large numbers of small containers with uniform portions of chitterlings. A worker must cut off a section of approximately the correct volume from the mass and must typically augment this initial portion with smaller portions to achieve the correct weight or volume. The difficulty of manually cutting the chitterlings adds an appreciable labor cost to a high volume, low margin, packing operation.

In the manual packing operation, the workers treat the chitterlings as discrete entities, in much the same way as they would when packaging groups of sausages or packing containers full of small fruits. However, the chitterlings have many of the attributes of a homogeneous mass, like grains or fluids and it are these very attributes that raise the cost of manually packaging chitterlings.

SUMMARY OF THE INVENTION

The present invention is directed toward machinery for separating predetermined volumes of chitterlings from bulk masses of chitterlings and loading the measured quantities into containers. The apparatus is designed to take advantage of the partially homogeneous, partially heterogeneous nature of a mass of chitterlings and takes a form that is relatively simple, so as to be highly reliable in operation, yet capable of loading the individual containers at a rapid rate.

Broadly, the invention contemplates storing a mass of chitterlings and using gravity feed to fill a volumetric container from the mass. Cut-off means are provided to separate the volume in the dispenser from the mass by scissoring action, and then the contents of the dispenser are gravity fed to open top containers carried under the dispenser on a conveyor.

A preferred form of the apparatus, which will subsequently be disclosed in detail, employs an open topped, sloped sided hopper, of the type used to dispense bulk, particulate materials. The hopper is loaded with a mass of chitterlings by means of a large open topped vessel that is supported on a upwardly inclined elevator. When the vessel is at the bottom of the elevator it may be conveniently loaded with chitterlings and when it is elevated above the top of the hopper it may be tipped by a fluid mechanism to dump chitterlings from the vessel into the hopper.

A volumetric measuring and dispensing chamber is supported at the lower end of the hopper. A partition which moves horizontally to allow chitterlings to fall into the dispensing chamber from the hopper and then closes off the top of the chamber, has a sharpened cutting edge which coacts with an affixed blade to cut off lengths of chitterlings extending between the hopper and the dispenser. After the cut-off mechanism has closed the top of the dispenser, a bottom plate swings open and the contents of the dispensing chamber are dropped into an open topped container supported on a horizontal conveyor beneath the chamber.

A nested stack of the small containers is supported above one end of the conveyor and a separator mechanism drops the bottommost container from the stack onto the conveyor. The conveyor then moves this container under the dispenser and simultaneously moves a filled container off the far end of the conveyor onto a loading position of a turntable. An operator standing by the turntable may cap the containers as they pass by him and remove them from the turntable. He may also inspect the contents of the containers and manually augment the contents as required.

The cut-off and dispensing actions, the separation of the individual container from the stack, and the motion of the conveyor are sequentially and automatically timed by a conventional control system. Manually controlled fluid power means is also provided for the vessel elevating and tilting mechanism.

The volumes of chitterlings dispensed by the system are sufficiently accurate that the loading apparatus may be used even when chitterlings must be sold by weight. The system is simple and highly reliable in operation and performs the loading operation at a low cost.

Other objectives, advantages and applications of the invention will be made apparent by the following detailed description of the preferred embodiment. The description makes reference to the accompanying drawings, in which:

FIG. 1 is a perspective view of a chitterling packing machine formed in accordance with a preferred embodiment of the invention, illustrating the hopper loading mechanism in an alternative position with dotted lines;

FIG. 2 is a sectional view through the volumetric measuring and dispensing unit taken along lines 2—2 of FIG. 1;

FIG. 3 is a detailed plan view of the cut-off mechanism taken along line 3—3 of FIG. 2; and FIG. 4 is a detailed elevational view through the cut-off mechanism taken along line 4—4 of FIG. 2.

The preferred embodiment of the chitterling packing machine is built about a hopper, generally indicated at 10, adapted to receive and support a bulk volume of chitterlings, as accumulated in a slaughterhouse operation. The hopper 10 has four rectangularly arrayed vertical sides 12 and an open top. Inclined walls 14 slope downwardly and inwardly below the bottoms of the sides 12 and terminate in a vertical dispensing throat 16. The hopper 10 is supported above the packinghouse floor 18 on four right angle steel beams 20 which engage the corners formed by the sides 12.

The hopper 10 may be filled from a loading vessel, generally indicated at 22. The loading vessel is pyramidal in shape with a pair of side walls 24 that extend parallel to one another, and front and rear walls 26 and 28 respectively, that slope toward one another to form an apex at the bottom of the vessel. The vessel is pivotably supported for motion about an axis parallel to this apex by hinges 30 affixed to the vessel at its base and hingedly supported on a horizontal axle 32.

The hinges are movable along channel shaped upwardly inclined guideways 36 supported in parallel spaced relationship to one another and form a trackway for the vessel 22. The axle 32 is moved along this trackway by the rod 38 of a pneumatic cylinder 40. The cylinder has its base affixed to a rod 42 which extends between the guideways 36 at their lower ends. A plate 44 which extends between the guideways acts as a bearing plate for the outer side of the front wall 26 of the vessel at all positions except its extreme position, retaining the vessel in an upright position.

When the rod 38 of the cylinder 40 is retracted, the vessel 22 is supported near the bottom of the guide rails 36 and may be manually loaded with chitterlings through its open top. When the hopper 10 is to be refilled, the cylinder 40 extends its rod 38, lifting the vessel 22 along the trackway until the vessel reaches the top end of the bearing plate 44. At that point gravity forces cause the loaded vessel to tilt downwardly, about the axle 32, as shown in the full lines in FIG. 1. The chitterlings contained in the vessel are then dumped into the hopper. The vessel may then be lowered along the guideway for refilling.

Chitterlings loaded into the hopper 10 fall to the bottom of the hopper, filling the throat 16. They are normally blocked at the bottom of the throat by a cutoff blade 48 (FIG. 3). The blade 48 has a sharpened, canted edge 52 that cooperates with the top and bottom end plates 54, supported on one side of the throad 16, to cut chitterlings extending downwardly from the throat, in a manner which will be subsequently described.

The blade 48 may be moved in a horizontal plane by a cylinder 56 between an open position, wherein it is retracted from the throat 16, and supported beneath a retaining plate 58, and a closed position wherein it seals off the bottom of the throat 16. A rectangular volumetric measuring and dispensing chamber 60 is supported below the throat 16 and is separated therefrom by the cutting blade 48, when the blade is in its closed position. When the blade 16 is retracted to its open position, within the retainer 58, the volume within the neck 16 communicates with the volume within the dispensing chamber 60 and chitterlings fall into the chamber 60, filling it. The bulk characteristics of the chitterlings assure that the volume 60 is filled when there are sufficient chitterlings within the hopper because the chitterlings tend to flow and the upper chitterlings exert a pressure on the lower chitterlings, forcing them downwardly.

The bottom of the dispensing chamber 60 is normally closed off by a second cutter blade 62 which is actuated by a cylinder 64 between a closed position, wherein it seals off the bottom of the dispensing chamber 60, and an open position wherein it is retracted from the dispensing chamber. The blade 62 cooperates with end plates 64 to provide a scissors action upon closing.

The cylinders 56 and 64 are controlled by a conventional pneumatic power source (not shown) equipped with manual controls 68, so that they are sequentially actuated to first fill the dispensing chamber 60 with a volume of chitterlings, then close off the dispensing chamber from the hopper 10 and then open the bottom of the dispensing chamber to drop its contents into a pail type container 66 which may be formed of plastic or coated cardboard, disposed beneath the dispensing chamber.

Considering the dispensing cycle, assume that the cylinder 56 has retracted the blade 48 and the cylinder 64 has extended blade 62. This condition is illustrated in FIG. 2. The chitterlings then fall from the hopper into the volumetric chamber 60. Next the cylinder 56 is controlled to cause it to extend its rod 48 which moves between the guides 50 cutting off any chitterlings which extend between the throat 16 and the chamber 60. The scissors action produced between the edge 52 of the blade and the cooperating end plates 54, completely severs the chitterlings. After the blade 48 has closed off communication between the throat 16 and the chamber 60, the cylinder 64 retracts the blade 62 allowing the contents of the volumetric chamber to fall into a container 66. The cylinder 64 then extends its rod, closing off the bottom of the chamber, and cutting off any chitterlings which may be hanging between the volume 16 and the container 66. The cylinder 56 then retracts the blade 48 allowing the volumetric chamber to be refilled.

A container 66 to be filled is supported on a horizontal belt conveyor 70. The containers 66 are loaded onto the conveyor from a stack supported on wire guide tracks 72. The bottommost container in the stack may be dropped onto one end of the conveyor 70 by a mechanism including pneumatic cylinders 74 and 76. The rod of the cylinder 76 blocks the bottom of the lowermost container in the stack. The rod of the cylinder 74 extends beneath the rim of the second lower container to block motion of the stack when the rod of the cylinder 76 is retracted. Normally, both rods are extended. To drop the lowermost container from the stack onto the conveyor, the rod of the cylinder 76 is retracted. After the lowest container has dropped, the cylinder of the rod 76 is again extended and the cylinder rod 74 is retracted. The stack than lowers so that the next container is supported by the rod of cylinder 76.

After a container supported beneath the dispenser 60 has been filled with chitterlings and a new container has been dropped onto one end of the conveyor 70, the conveyor advances to move the filled container to a slide 72 which carries it down to an exit conveyor 74. Simultaneously, the new container is moved under the dispensing unit 60 and the dispensing operation may be repeated.

The embodiments of the invention in which an exclusive right or privilege is claimed are defined as follows:

1. Apparatus for the dispensing of controlled volumes of chitterlings comprising:

a hopper having an opening at the top and at the bottom;

means for loading chitterlings into said top opening of said hopper;

dispenser means including a dispenser chamber located at the bottom of said hopper, said dispenser chamber having a lower and upper opening, said upper opening disposed in communication with said hopper bottom opening;

means controllably closing off the lower opening of said dispenser chamber;

means selectively closing off the upper portion of said dispenser chamber, said means including a movable cut-off blade mounted to be moved across said upper opening, said plate having a cutting edge and said apparatus further including spaced end plates adapted to receive said sliding cut-off blade to scissor off the chitterlings extending between said cut-off blade and said dispenser chamber;

means controllably producing closing movement of said cut-off blade and for controllably opening said bottom closure when said cut-off blade closes the upper opening of said dispenser chamber;

means for packaging the quantity of chitterlings discharged from said dispenser chamber including means positioning a container beneath said dispenser chamber when said lower closure means is controllably operated to allow said chitterlings to be discharged from said dispenser chamber.

2. The apparatus according to claim 1 wherein said means closing said lower dispenser chamber opening includes a lower cut-off blade having a sharpened edge and wherein said apparatus further includes spaced end plates adapted to receive said sharpened lower cut-off blade so as to cause a scissoring action upon movement of said lower cut-off blade between said spaced end plates to cut off chitterlings extending between said lower cut-off blade and said end plates upon movement of said lower cut-off blade between said end plates.

3. The method of dispensing a quantity of chitterlings comprising the steps of:

disposing a dispenser chamber having an upper and lower opening beneath a container having a quantity of chitterlings loaded therein, the container having a lower opening allowing the chitterlings to move under the influence of gravity through the lower opening, disposing the dispenser chamber beneath said lower opening to receive a quantity of chitterlings sufficient to fill the dispenser chamber;

closing the lower opening of the dispenser chamber before the quantity of chitterlings is moved into said dispenser chamber;

closing the upper end of the dispenser chamber by moving a cut-off blade across the opening and scissoring off the chitterling lengths extending through the dispenser chamber opening;

opening the lower opening while the upper dispenser chamber opening is closed to allow the volume of chitterlings disposed in the dispenser chamber to be moved by gravity from the dispenser chamber.

4. The method according to claim 3 further including the step of cutting by scissoring action any chitterlings which extend through the lower opening upon closure of the lower opening.

5. The method according to claim 3 further including the step of disposing a container beneath the dispenser chamber while said chitterlings are being discharged from said dispenser chamber.

* * * * *